US007540691B2

(12) United States Patent
Godoy

(10) Patent No.: US 7,540,691 B2
(45) Date of Patent: Jun. 2, 2009

(54) WEIGHT POUCH RELEASABLE CONNECTION DEVICE FOR A SCUBA DIVING JACKET

(75) Inventor: Carlos Alberto Godoy, Genoa (IT)

(73) Assignee: Cressi-Sub S.p.A., Genoa (IT)

( * ) Notice: Subject to any disclaimer, the term of this patent is extended or adjusted under 35 U.S.C. 154(b) by 0 days.

(21) Appl. No.: 11/811,566

(22) Filed: Jun. 9, 2007

(65) Prior Publication Data

US 2008/0019778 A1 Jan. 24, 2008

(30) Foreign Application Priority Data

Jun. 9, 2006 (IT) ..... FI2006A0143

(51) Int. Cl.
*B63C 11/02* (2006.01)
*A45C 11/00* (2006.01)

(52) U.S. Cl. ..... 405/186

(58) Field of Classification Search ..... 405/186
See application file for complete search history.

(56) References Cited

U.S. PATENT DOCUMENTS

| | | | | |
|---|---|---|---|---|
| 4,831,694 | A | 5/1989 | Kong | 24/625 |
| 5,256,094 | A | 10/1993 | Canna | 441/96 |
| 5,746,542 | A * | 5/1998 | Carmichael | 405/186 |
| 5,803,667 | A * | 9/1998 | Seligman | 405/186 |
| 6,030,147 | A * | 2/2000 | Bowden | 405/186 |
| 6,487,761 | B2 | 12/2002 | Van Tassel | 24/606 |
| 6,527,480 | B2 * | 3/2003 | Angelini et al. | 405/186 |
| 6,558,082 | B1 | 5/2003 | Carmichael et al. | 405/186 |
| 6,722,819 | B2 | 4/2004 | Godoy | 405/186 |
| 6,749,370 | B1 * | 6/2004 | Urabe et al. | 405/186 |
| 6,758,635 | B1 * | 7/2004 | Feng | 405/186 |

(Continued)

FOREIGN PATENT DOCUMENTS

WO WO0210012 2/2002

*Primary Examiner*—Frederick L Lagman
(74) *Attorney, Agent, or Firm*—Pollack, P.C.

(57) ABSTRACT

A device for releasably connecting a weight pouch to a pocket of a scuba diving jacket. The device comprises a relatively flat sheath connected to and integrally with the diving jacket. A latch member is attached to the weight pouch, the latch member having arms that are elastically deformable in a plane of the sheath and sides tapered relative to a longitudinal plane of symmetry of the sheath to provide snap closure when the latch member is inserted in the sheath. An inward ly-projecting abutment inside the sheath engages ends of the arms when the device is in a closed position, thereby preventing the latch member from sliding out of the sheath. A member is provided for bending the arms of the latch member so as to release them from a position such that they meet the abutment and enable the device to be opened. The bending member includes a cap slidingly mounted on the latch member and contains tapered projections for engaging the tapered sides of the arms. Upon movement of the cap relative to the latch member that induces elastic deformation of the arms, the tapered projections release the ends of the arms from the abutment in the sheath. The cap and the latch member are preferably connected to the same handle for inducing their relative movement by respective flexible connection elements. The element connecting the handle to the latch member is longer than that connecting the handle to the cap, so that the tensile force exerted on the handle first causes relative movement of the cap with respect to the latch member inside the sheath.

9 Claims, 5 Drawing Sheets

U.S. PATENT DOCUMENTS 6,966,726 B2 * 11/2005 Kawashima ..... 405/186
7,104,729 B2 9/2006 Cressi ..... 405/186
2002/0067955 A1 * 6/2002 Carmichael ..... 405/186
2005/0074295 A1 * 4/2005 Kawashima ..... 405/186

* cited by examiner

WEIGHT POUCH RELEASABLE CONNECTION DEVICE FOR A SCUBA DIVING JACKET

FIELD OF THE INVENTION

The present invention relates generally to equipment for use in limited oxygen environments and, more particularly, to articles for aquatic activities and the like.

BACKGROUND OF THE INVENTION

Scuba diving jackets typically have pockets designed to hold ballast elements or "weights", e.g., made of lead, for facilitating the diver's immersion. The weights are not merely placed in the pockets of the jacket, but rather are selectively combined into one or more pouches that are added to the pockets until the weight desired by the diver and, hence, buoyancy has been achieved. Each pouch, which generally contains one or more weights, is then inserted into the pocket. It is considered necessary that each pouch be attached to the scuba diving jacket by a releasable connection device that prevents the pouch from falling accidentally out of the pocket, while allowing for quick and easy release of the pouch when the diver wishes to accelerate his/her return to the surface or, alternatively, to delay descent.

The connection device usually comprises a quick engagement buckle, formed of a female part having a sheath integrally attached to the jacket and a male part with a latch member that includes one or more elastically deformable teeth designed to cooperate with a corresponding engagement member provided within the sheath. The connection device is attached, at the other end of the latch member, to the weight pouch.

Like most quick engagement buckles, this one is closed by simply pushing the latch member inside the sheath. Relative movement of the latch member and sheath causes elastic deformation of the teeth on the latch member as they abut corresponding engagement members in the sheath. More specifically, when the teeth on the latch member pass beyond the engagement member, they return to their undeformed condition and cooperate with the engagement member, thereby preventing the buckle from opening.

Consequently, the buckle may only be opened by intentional action that again deforms the teeth on the latch member and thus disengages them from the engagement member in the sheath.

In conventional scuba diving jackets, to open the buckle, users must use their fingers directly, i.e., to elastically deform the teeth on the latch member. Since users usually wear neoprene gloves of considerable thickness (3 to 5 mm) when scuba diving, they often find it difficult to place their fingers over the two side slots on the female part of the buckle to squeeze the teeth on the latch member.

In a "fast" type fastening buckle, which is not specifically intended for scuba diving equipment, a sliding cap is provided on the buckle for squeezing the teeth on the latch member. While useful this solution is designed for general applications, and has been found difficult to apply to a weight pouch because the diver still has to move the sliding cap with his/her gloved fingers.

With other known arrangements, the buckle may be opened using a handle. In particular, the teeth on the latch member are connected to the handle by a flexible connection, such as a tape, such that the buckle is opened by simply pulling the handle.

Although serviceable, this device has been found disadvantageous in that the handle for opening the buckle may be easily caught in an obstacle, resulting in accidental opening of the buckle and, in turn, loss of the pouch and of the weights it contains.

In an effort to overcome these drawbacks, an arrangement was then developed in which the latch member of the quick engagement buckle is associated with an element for locking the member. When the handle is operated so as to open the device, the locking element is released, such being a first, relatively brief step of opening the buckle. As a second step, continued tensile action on the handle causes the latch member to withdraw from the sheath, thus opening the buckle.

To this end, the locking member and the latch member are connected in parallel to the same handle by a pair of flexible elements, the element connected to the locking member being the shorter of the two. Accordingly, when the handle is intentionally pulled by the user, the opening and withdrawing steps are very brief, with no interval between them, and any inadvertent tugging forces on the handle are not capable of maintaining the continuity of tensile action necessary to open the buckle.

This device is also considered problematic because, in order to close the device, the scuba diver must perform two operations instead of one, namely, first inserting the latch member and then the locking member. However, since the locking member can be inserted even before the latch member has reached the end of its stroke, there is still a margin of risk, albeit modest, that the buckle will open, and the pouch and weights it contains will be lost.

OBJECTS AND SUMMARY OF THE INVENTION

Accordingly, it is an object of the present invention to provide a device for releasably connecting a weight pouch to a weight holding pocket of a scuba diving jacket that prevents accidental opening of the buckle and, in turn, loss of the pouch and the weights it contains.

Another object of the present invention is to provide a device for releasably connecting a weight pouch t a weight holding pocket of a scuba diving jacket that can be released with less effort than that required by conventional devices, while affording greater safety.

SUMMARY OF THE INVENTION

According to one aspect of the present invention, a device is provided for releasably connecting a weight pouch to a weight holding pocket of a scuba diving jacket. The device comprises a relatively flat sheath attached to and integrally with the jacket, a latch member connected to the weight pouch, the member having arms that are elastically deformable in a plane of the sheath with sides tapered relative to a longitudinal plane of symmetry of the sheath for enabling snap closure when the latch member is inserted in the sheath, and an inwardly projecting abutment inside the sheath for engaging the ends of the arms when the device is in a closed position, thus preventing the latch member from sliding out of the sheath. A member is also provided for bending the arms of the latch member inwardly so as to release them from the closed position, and thus to enable the device to be opened. The bending member comprises a cap mounted slidingly on the latch member with tapered projections configured for engaging the tapered sides of the arms in order to release the ends of the arms from the abutment inside the sheath as a result of movement of the cap relative to the latch member that induces elastic deformation of the arms. The cap and the latch member are connected to a handle for inducing the relative movement through respective flexible connection elements, the element connecting the handle to the latch member being generally longer than the element connecting the handle to the cap, whereby a tensile force exerted on the handle first causes the movement of the cap relative to the latch member inside the sheath.

BRIEF DESCRIPTION OF THE DRAWINGS

A specific, illustrative device for releasably connecting a weight pouch to a weight holding pocket of a scuba diving jacket, according to the present invention, is described below with reference to the accompanying drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
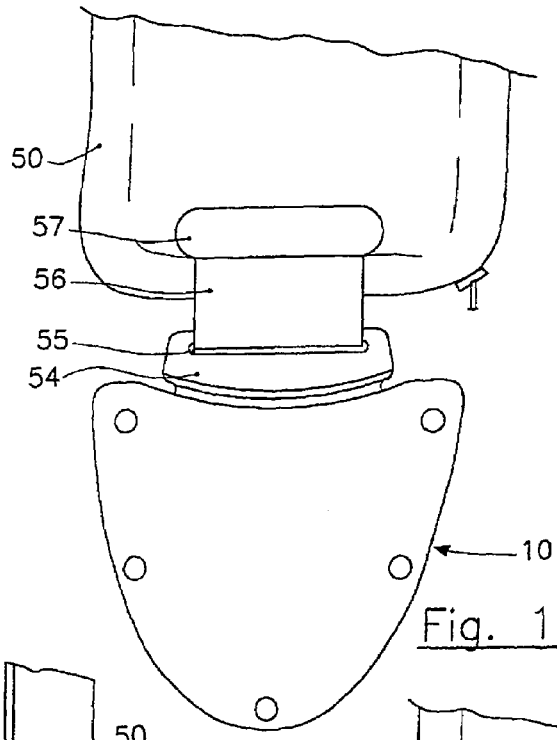
FIG. 1 is a front view of a device, for releasably connecting a weight pouch to a weight holding pocket of a scuba diving jacket, according to one aspect of the present invention.
Figure 2A:
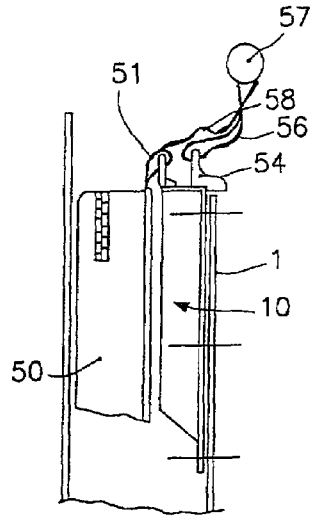
FIG. 2*a* shows schematically the connection device of FIG. 1 and the corresponding case positioned inside the weight holding pocket.
Figure 2:
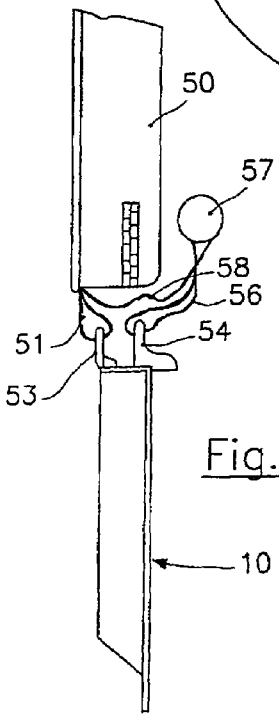
FIG. 2 is a side view of the device shown in FIG. 1.
Figure 3:
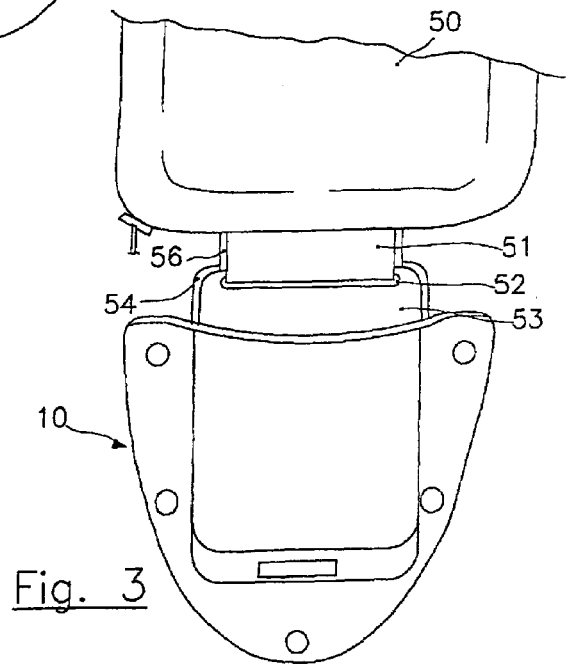
FIG. 3 is a rear view of the device set forth in FIG. 1.

Referring now to the drawings and, more particularly, to FIGS. 1-23, there is shown generally a specific, illustrative device for releasably connecting a weight pouch to a weight holding pocket 1 of a scuba diving jacket, according to various aspects of the present invention. In one embodiment, illustrated in FIGS. 1-4, the device comprises a female member, or sheath, 10 preferably attached to the inside of the weight holding pocket, as best seen in FIG. 2*a*. A male member reversibly engaging a snap closure 20 in the sheath is also provided, which includes a cap 30, to which a latch member 40 is attached. The device is joined to a weight pouch 50, such as one of a conventional type for insertion in pocket 1, as shown in FIG. 2*a*, by a first tape 51 engaged in a slot 52 of a flange 53 projecting from the sheath and attached to, and integrally with, the latch member. Alongside flange 53, which projects from the sheath, a second flange 54 projects from cap 30, the second flange having a second slot 55, in which a first tape 56 terminating with a handle 57 is engaged. As illustrated in FIG. 2, the handle is additionally connected to the weight pouch through a second tape 58.

Generally speaking, the term "inner" is intended to mean "facing toward the body of the scuba diver", while the word "outer" is intended to refer to "facing away from the body of the scuba diver".

As shown in FIGS. 5-9, sheath 10 preferably has a substantially box-like structure with a relatively flat rectangular cross-section. The sheath comprises an outer wall 11, substantially in the shape of a flange, secured within weight holding pocket 1 in a conventional manner, as illustrated in FIG. 2*a*. Two side walls 12, 13 extend perpendicularly from one side of the outer wall, and a rear wall 14 extends from the same side of the outer wall and links the respective side walls to one another. Furthermore, an inner wall 15 is positioned generally parallel to the outer wall and attached to the side walls 12, 13 and rear wall 14, thereby defining a cavity 16 accessible through an opening 17 opposite the rear wall for enabling insertion of male member 20. Again, the male member comprises cap 30 which contains latch member 40.

On the side of outer wall 11 facing cavity 16, an abutment is provided in the form of a pair of prism-shaped projections 18, positioned relatively symmetrically in relation to a selected longitudinal axis Y-Y of the device. A corresponding pair of prism-shaped projections 19, opposite projections 18, extend desirably from the side of inner wall 15 facing the cavity. A seleted distance h1 between projections 18, and a selected distance h2 between the opposite ends of projections 19, are configured so as to allow passage of the latch member, as set forth in greater detail below.

Cap 30, according to one arrangement illustrated in FIGS. 10-15, is substantially U-shaped and has a pair of relatively parallel arms 31 extending from flange 54 on the side opposite to slot 55. The arms are preferably joined to one another by a diaphragm 32 extending from their base, while a stiffening cross member 33 links their free ends to one another. Respective grooves 34 are formed along the arms, the grooves having an intermediate section 35 passing from one side of the arms to the other. On the sides of the arms facing one another, two wings 36 are formed, the wings being positioned approximately halfway along the length of the arms. The wings 36 preferably have edges 37 tapered symmetrically toward flange 54 and cover only a central part of the thickness of the arms as shown, for instance, in FIG. 10. On an inner side of the diaphragm, a tooth 38 is provided, the purpose of which is described in further detail below.

Turning now to FIGS. 16-21, the latch member comprises a flange 53, on which slot 52 is formed, with a pair of generally parallel arms 59, 60 extending therefrom. In particular according to one embodiment, arms 59, 60 extend tangentially from one side of the flange. Each arm desirably has a substantially C-shaped cross-section, defined by a pair of relatively parallel walls 59*a*, 59*b* and 60*a*, 60*b*. Toothed ribs 61 project from side walls 59*a* and 60*a*,respectively, of arms 59 and 60, whereas opposing walls 59*b* and 60*b* of the arms are joined by a frame 62 lying in a plane substantially parallel to the flange. The frame preferably defines a window 63 divided into two parts by a cross member 64.

Figure 16:
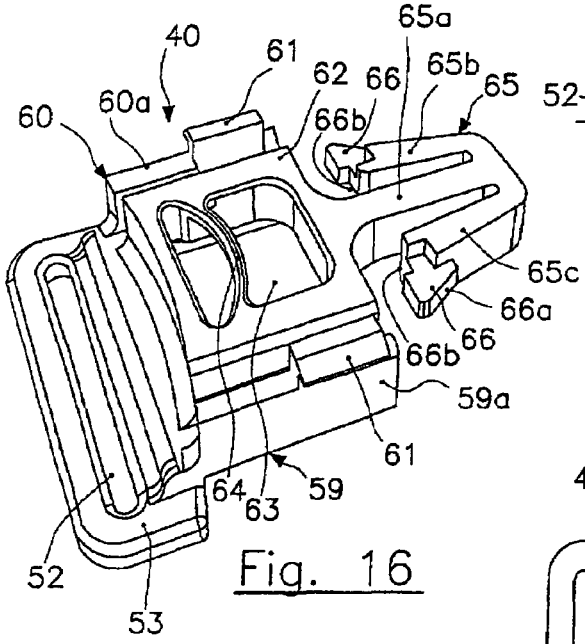
FIG. 16 is a perspective view of a latch member for the device, according to another aspect of the present invention.
Figure 17:
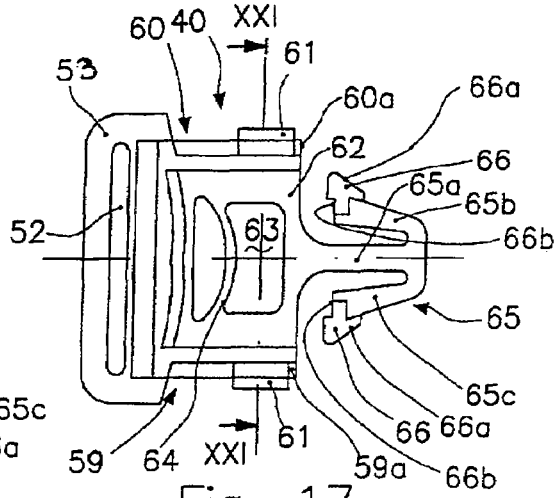
FIGS. 17 and 18 are front and rear views, respectively, of the latch member shown in FIG. 16.
Figure 18:
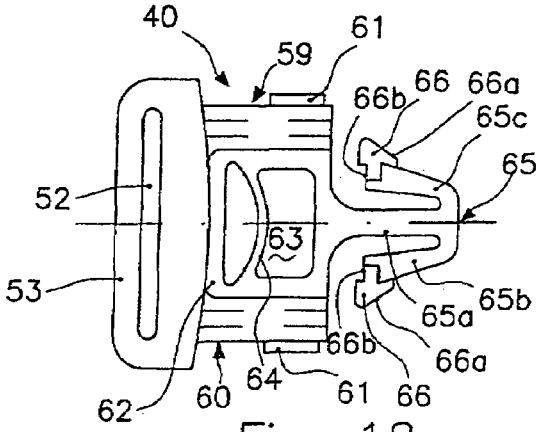
Figure 20:
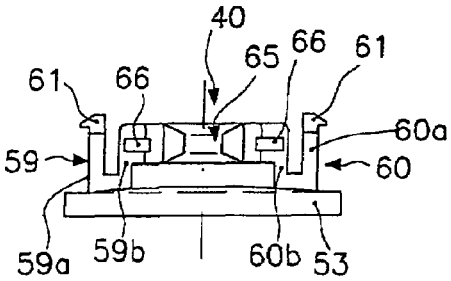
FIG. 20 is an end view of the latch member illustrated in FIG. 16.
Figure 19:
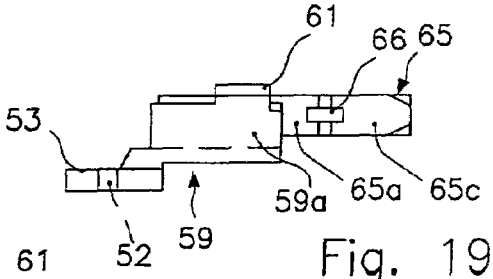
FIG. 19 is a side view of the latch member set forth in FIG. 16.
Figure 21:
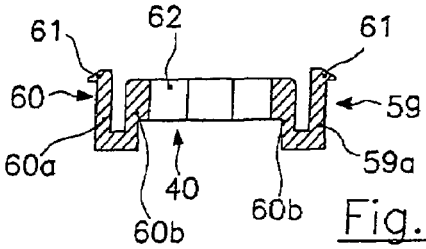
FIG. 21 is a sectional view of the latch member taken along line XXI-XXI in FIG. 17.
Figure 22:
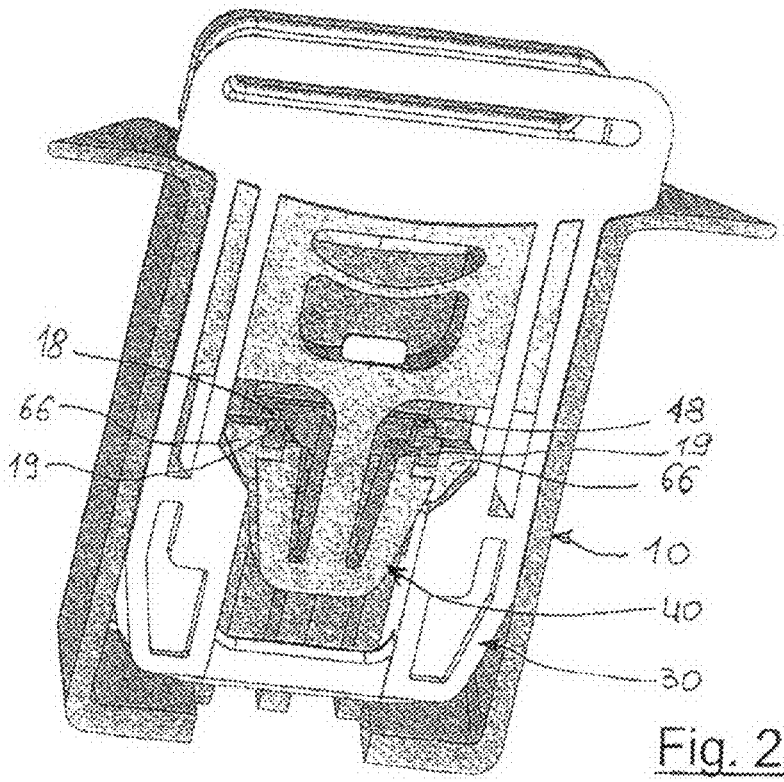
FIGS. 22 and 23 show, respectively, the device of FIG. 1 in a closed position and immediately prior to removal of the pouch from the pocket.
Figure 23:
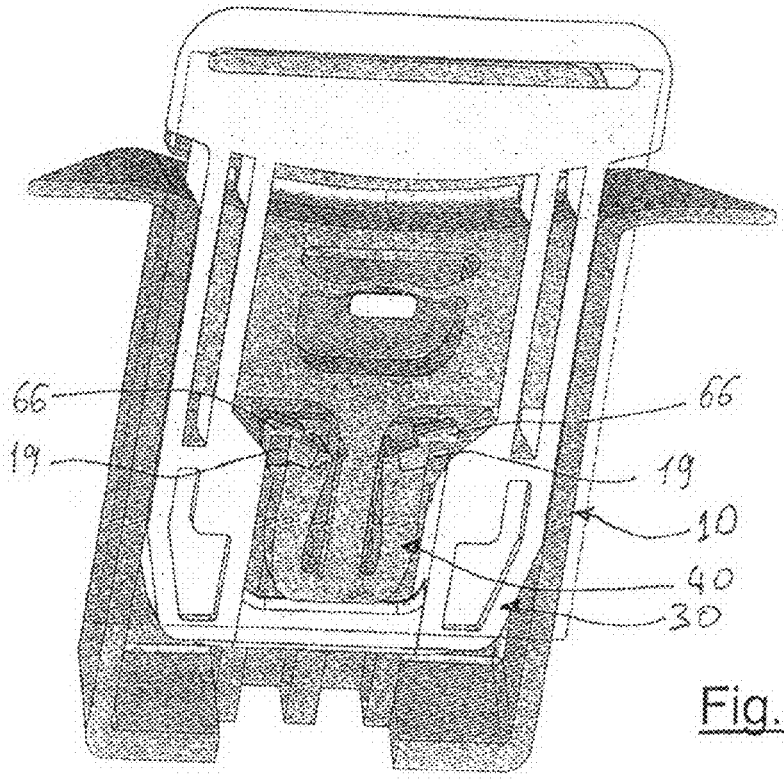

It is preferred that a substantially T-shaped bracket 65 extend from the frame on the side opposite flange 53, the bracket being formed, for instance, by a bar 65*a* and two relatively symmetrical arms 65*b*, 65*c* bent back diagonally toward the base of the bar and, as a result, lying substantially adjacent to and astride the bar. Teeth 66 desirably project from the free ends of arms 65*b* and 65*c*, respectively, and generally in the same plane, but on opposite sides relative to an axis of bar 65*a*, with tapered edges 66*a* and recesses 66*b* on their free edge adjacent tapered edge 66*a*. As best seen in FIGS. 16 and 19, teeth 66 are generally thinner than arms 65*b*, 65*c* and are arranged in an intermediate position relative to the thickness of the arms.

Figure 4:
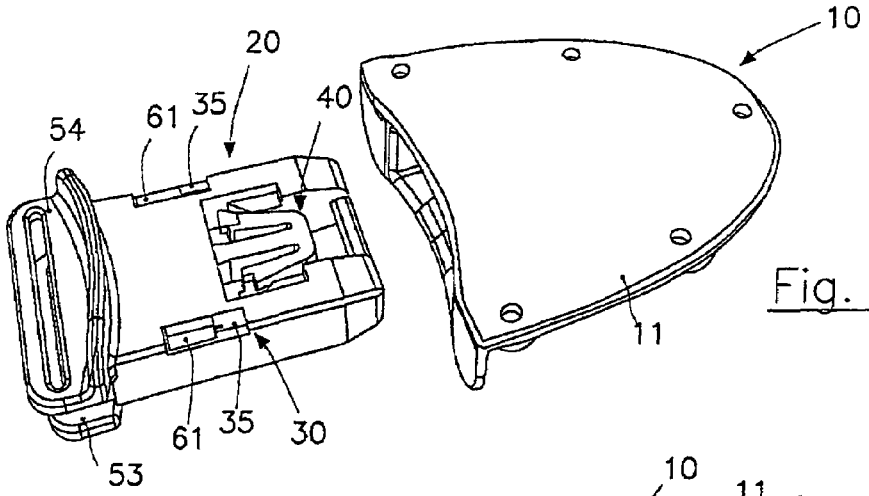
FIG. 4 is a perspective view of a female member, or sheath, of the device shown in FIG. 1, and of a male member of the device, which comprises a latch member inserted in a cap according to one aspect of the present invention.
Figure 5:
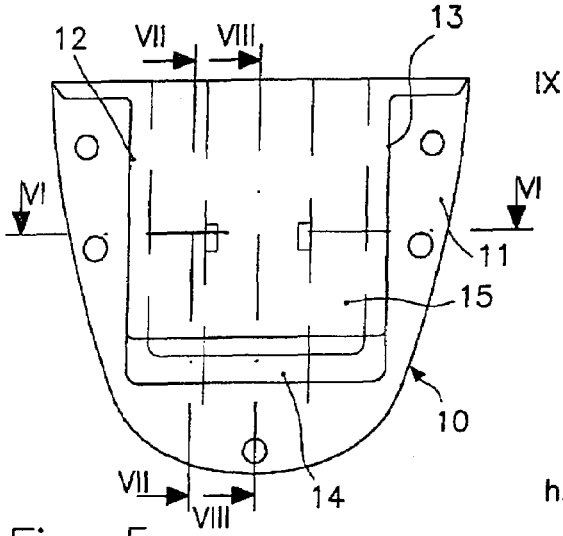
FIG. 5 is a rear view of the sheath illustrated in FIG. 4.
Figure 6:
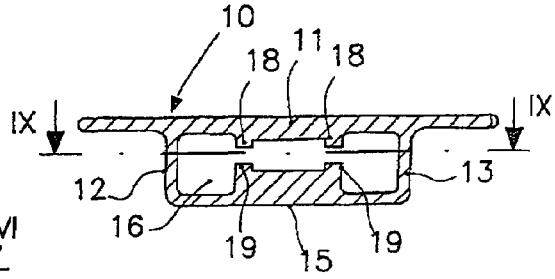
FIG. 6 is a sectional view of the device taken along line VI-VI in FIG. 5.
Figure 7:
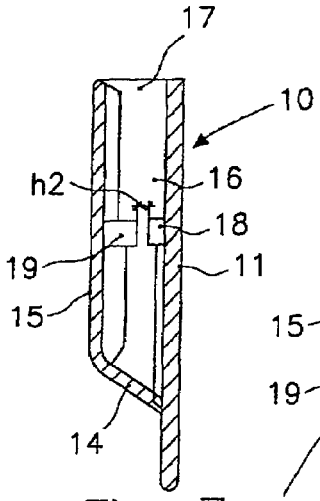
FIGS. 7 and 8 are sectional views taken axially along lines VII-VII and VIII-VIII in FIG. 5.
Figure 8:
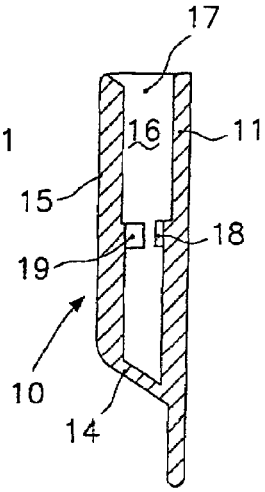
Figure 9:
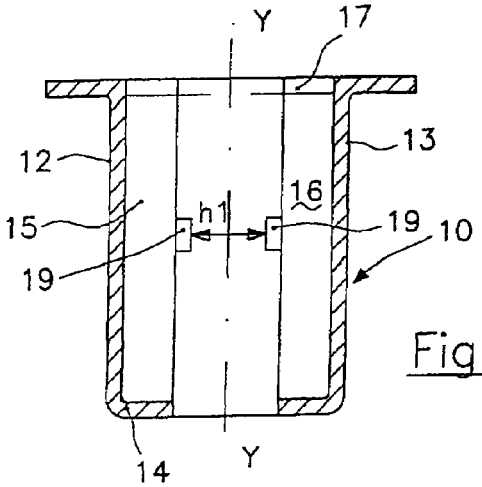
FIG. 9 is a sectional view taken along line IX-IX in FIG. 6.
Figure 10:
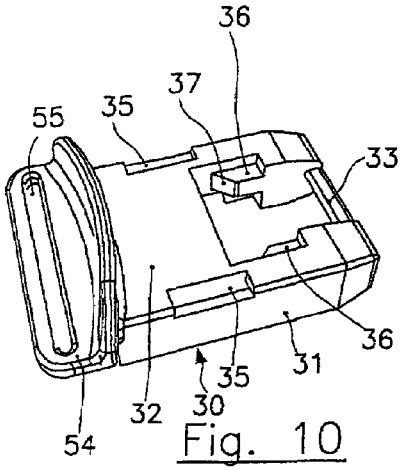
FIG. 10 is a perspective view of the cap for the device shown in FIG. 4.
Figure 11:
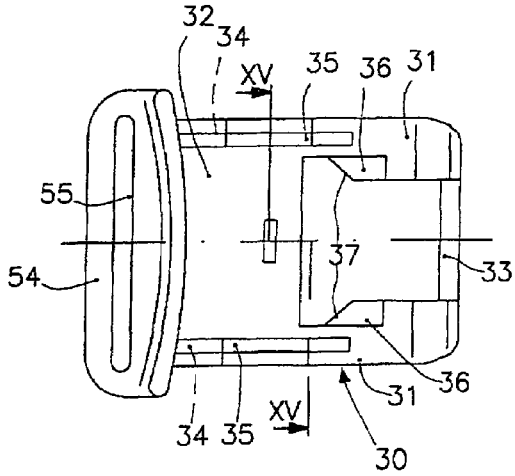
FIG. 11 is a front view of the cap illustrated in FIG. 10.
Figure 15:
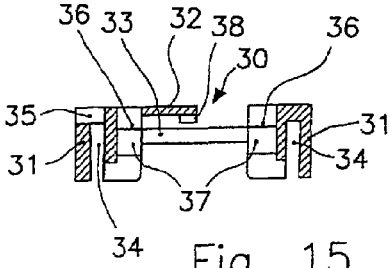
FIG. 15 is a sectional view of the cap taken along line XV-XV in FIG. 11.
Figure 12:
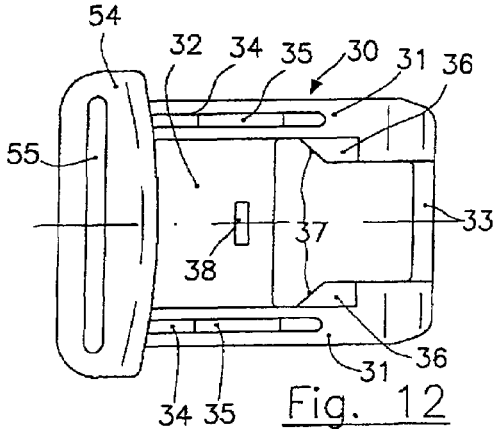
FIG. 12 is a rear view of the cap shown in FIG. 10.
Figure 13:
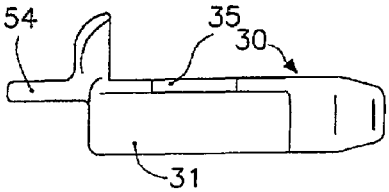
FIG. 13 is a side view of the cap set forth in FIG. 10.
Figure 14:
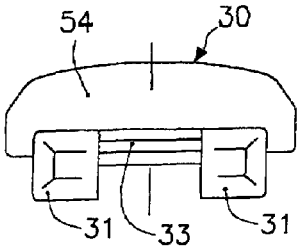
FIG. 14 is an end view of the cap in FIG. 10.

As best seen in FIG. 4, latch member 40 is attached securely to cap 30 by insertion of side walls 59*a*, 60*a* in grooves 34 in the cap so as to engage toothed ribs 61 with a snap closure inside through sections 35 in grooves. Once the latch member has been inserted in the cap, tapered edges 66*a* of teeth 66 on bracket 65 abut corresponding tapered edges 37 of opposing wings 36 on arms 31.

When the latch member and cap have been so assembled as to form male part 20 of the device, the male part may be inserted into sheath 10 through opening 17, the part sliding axially along and inside the sheath. During this sliding step, open arms 65*b*, 65*c* of latch member 40 slide between prism-shaped projections 18, 19, slidingly abutting the same, as distance h1 between the projections of each pair of arms is generally less than the width of the bracket. In this manner, the arms bend toward bar 65*a* until teeth 66, the thickness of which is less than distance h2, have passed completely between opposing projections 18, 19. Once the teeth have passed between the projections, arms 65*b*, 65*c* open out again, thereby causing tapered edges 66*a* of the teeth to abut tapered edges 37 of projections 36 on cap 30. Projections 18, 19, having ridden over the free ends of the arms, then snap into recesses 66*b* in the teeth. In this condition, male part 20, which comprises the cap and the latch member, is locked inside the sheath as projections 18 and 19 abut the free ends of arms 65*b*, 65*c* and thus prevent the male part from sliding out.

Upon application of a tensile force on the cap, through handle 57 and tape 56 attached to flange 54 of the cap, movement of the cap relative to latch member 40 is induced. Movement in this fashion occurs because the latch member is generally immobile with respect to the sheath, whereas the cap may slide in relation to the latch member along juxtaposed tapered edges 37, 66*a* of wings 36 and teeth 66, respectively. This sliding action causes arms 65*b*, 65*c* to bend toward bar 65*a* until projections 18, 19 disengage from respective recesses 66*b* at the ends of the arms. The arms may therefore pass between opposing projections 18, 19, and the teeth between such projections (because their thickness is generally less than $h_2$), thereby enabling the male part to slide out of the sheath.

Once the tensile force exerted on the cap causes it to slide relative to the latch member to a point where the projections disengage from corresponding recesses 66*b*, tooth 38 on diaphragm 32 abuts arched cross member 64 on latch member frame 62. Consequently the arched crossbar operates as a return spring for the latch member in relation to the cap, restoring contact between teeth 66 and wings 36. It is noted that the return spring effect of cross member 64 is auxiliary to the natural spring effect exerted by the arms in their bent position, due to their structure and the memory forces inherent in the material of their construction, which causes a tendency to return to their undeformed position as soon as they are released from the projections.

Generally speaking, it is considered important that tape 56 joining the cap to handle 57 be shorter than tape 58 joining the same handle to the latch member. Hence, when the user begins to pull on the handle, the associated tensile force is first transmitted only to cap 30, which slides a limited distance allowable inside sheath 10, while the latch member does not move. Once the male part has been withdrawn from the sheath, if the user pulls further on the handle, a tensile stress is induced on tape 58 connecting latch member 40 to weight pouch 50, which may, therefore, be removed from the pocket of the diving jacket. It is noted, in addition, that tape 58 connecting the handle to the latch member, and tape 51 joining the latch member to the weight pouch may comprise a single tape passing through slot 52 and stitched suitably in place to prevent it from sliding therein.

Conversely, if the weight pouch accidentally becomes dislodged from the pocket, it remains attached to the latch member and cannot be lost, since the latch member cannot slide out of the sheath unless a tensile force or stress is applied intentionally to the cap by the user.

Accordingly, such movement of the cap relative to the sheath, as is needed to bend arms 65*b*, 65*c* until their ends are released from projections 18, 19 (in turn, enabling sliding motion of the latch member and opening of the device) provide a safety feature that prevents any accidental opening of the device during use.

Various modifications and alterations may be appreciated based on a review of this disclosure. These changes and additions are intended to be within the scope and spirit of the invention as defined by the following claims.

What is claimed is:

1. A device for releasably connecting a weight pouch to a pocket of a scuba diving jacket, the device comprising a relatively flat sheath attached to and integrally with the jacket; a latch member attached to the weight pouch and comprising arms elastically deformable in a plane of the sheath with sides tapered relative to a longitudinal plane of symmetry of the sheath enabling snap closure when the latch member is inserted in the sheath; an inwardly projecting abutment inside the sheath that engages the ends of the arms when the device is in a closed position for preventing any further sliding of the latch member; a member for bending the arms of the latch member so as to release the arms from a position in which they meet the abutment inside the sheath, and thus enable the device to be opened; wherein the bending member includes a cap slidingly mounted on the latch member, with tapered projections configured for engaging the tapered sides of the arms to release the ends of the arms from the abutment upon movement of the cap relative to the latch member that induces elastic deformation of the arms, the cap and the latch member both being connected to a handle for inducing the relative movement by respective flexible connection elements, the element connecting the handle to the latch member being generally longer than the element connecting the handle to the cap, whereby pulling on the handle first induces the movement of the cap relative to the latch member inside the sheath.

2. The device set forth in claim 1, wherein the abutment comprises two pairs of opposing projections extending from the two opposite walls inside the sheath, the elastically deformable arms of the latch member having teeth projecting laterally and coplanarly from their ends, the thickness of the teeth being narrower than the distance between the opposite ends of the pairs of projections and lying in an intermediate position between the pairs, the teeth having tapered edges abutting the tapered projections in the cap during the relative movement between the cap and the latch member.

3. The device set forth in claim 1, wherein the cap comprises two generally parallel arms formed with two grooves, an intermediate section of which passes from one side of the arms of the cap to the other, the latch member also having a pair of relatively parallel arms from which toothed ribs extend, respectively, configured for engaging a snap in thethrough section in the grooves so as to enable relative movement between the cap and the latch member of an amplitude no greater than the length of the through section.

4. The device set forth in claim 3, wherein the arms of the latch member have a substantially C-shaped cross-section defined, for each arm, by a pair of parallel walls, the toothed ribs extending from outer sides of the pair of parallel walls.

5. The device set forth in claim 1, wherein the latch member comprises a substantially T-shaped bracket formed by a bar and two relatively symmetrical arms bent back diagonally toward the base of the bar, with the side teeth projecting coplanarly from the free ends of the arms, on opposite sides with respect to an axis of the bar, the teeth having tapered edges configured for engaging the tapered projections on the cap, and respective recesses on their free edge adjacent to the tapered edge arranged for engaging the abutment inside the sheath.

6. The device set forth in claim 1, wherein a tooth projecting from an inner side of the cap abuts a cross member linking the arms of the latch member during relative displacement between the cap and the latch member.

7. The device set forth in claim 6, wherein the opposite sides of the pair of parallel walls forming the arms of the latch member are connected by a frame defining a window containing the cross member, the tooth moving between the cross member and the inner edge of the frame.

8. The device set forth in claim 7, wherein the cross member is in the shape of an arch with its convex side facing the tooth.

9. The device set forth in claim 1, wherein a flange extending from the cap, on the opposite side to the arms of the cap, is formed with a slot to which the handle is flexibly attached, and another flange extending from the latch member, on the opposite side to the arms in the latch member, is formed with a slot by which the weight pouch is flexibly attached to the handle.

* * * * *